US005163689A

United States Patent [19]

Bateman

[11] Patent Number: 5,163,689

[45] Date of Patent: Nov. 17, 1992

[54] TURNING TARGET SUPPORT STRUCTURE AND SYSTEM

[76] Inventor: Kyle E. Bateman, P.O. Box 636, Provo, Utah 84603-0636

[21] Appl. No.: 672,453

[22] Filed: Mar. 20, 1991

[51] Int. Cl.[5] ..... F41J 1/10

[52] U.S. Cl. ..... 273/406; 273/407; 273/403

[58] Field of Search ..... 273/406, 407, 403, 359

[56] References Cited

U.S. PATENT DOCUMENTS

| | | | |
|---|---|---|---|
| 2,104,171 | 1/1938 | Schwerin | 273/406 |
| 2,706,634 | 4/1955 | Van Valkenburg | 273/406 |
| 3,348,843 | 10/1967 | Stanley | 273/406 |
| 4,361,330 | 11/1982 | Scharer | 273/406 |
| 4,743,032 | 5/1988 | Summers | 273/406 |

FOREIGN PATENT DOCUMENTS

| | | | |
|---|---|---|---|
| 365009 | 10/1962 | Switzerland | 273/406 |

*Primary Examiner*—Benjamin Layno

[57] ABSTRACT

A target support structure and system which holds and turns a flat target from edge to face and back again. Targets are held and turned at the bottom and are supported at the top by a pivoting connection attached to a stationary bar frame. The system is easily mounted, is able to accomodate a variety of targets, may be activated through pneumatics or any adaptable power source, may be interfaced with electric, pneumatic, or similar control devices, and is uniquely designed to minimize bullet damage and splatter.

3 Claims, 2 Drawing Sheets

TURNING TARGET SUPPORT STRUCTURE AND SYSTEM

BACKGROUND

Other turning or moving systems that are commercially available suffer from one or more disadvantages which this present invention helps remedy. These disadvantages include being larger, heavier, less portable, relatively complex, incapable of independent operation, relatively slow reacting, subject to shock hazard, weather dependent, incapable of pneumatic actuation, insufficiently armored to provide long-term service with minimal maintenance, or incapable of providing variable speed or sequencing control. (See as samples U.S. Pat. Nos. 3,471,153; 3,814,429; 3,865,373; 4,029,318; 4,072,313; 4,076,247; 4,189,147; 4,385,767; 4,548,414; 4,461,925.) Some prior systems also require special stands or berms and cannot be simply mounted to a flat concrete pad or similar common base. None of the prior art devices known to the applicant provide this present invention's simple means of stabilizing the upper portion of the target through a flexible connection to a stationary bar frame. The method of armoring the face of this present invention is also not known to the applicant in prior art.

SUMMARY

It is an object of the present invention to provide an improved turning target system comprising:

1. An improved turning target system comprising:
   (a) a stand readily mounted to a flat solid surface;
   (b) a stationary horizontal top plate mounted on top of said stand;
   (c) a clamp mechanism mounted to said horizontal top plate, said clamp mechanism comprising a clamp for firmly clamping the bottom edge of any one of a variety of flat targets in an upright vertical postion, and a mechanism means for rotating said clamp and said target about a vertical axis relative to said stationary horizontal top plate;
   (d) a stationary bar frame mounted to said horizontal top plate, said stationary bar frame having a top portion extending upwardly above said target;
   (e) a flexible connection means having one end attached to said top portion of said stationary bar frame, and the other end attached to the upper portion of said target for stabilizing said target;
   (f) said mechanism means for rotating said clamp and said target referenced in (c) comprises pneumatics or any adaptable power source.
   (g) a design which allows interface with either an electric or a pneumatic control device for the power source referenced in (f) above;
   (h) an armor design which protects the actuating system referenced in (f) above; and
   (i) a design for protecting the system's support structure and minimizing bullet splatter, which design allows the mounting of a two by six board or similar facade to the front face of the system's base.

DESCRIPTION OF THE PREFERRED EMBODIMENT

Figure 1:
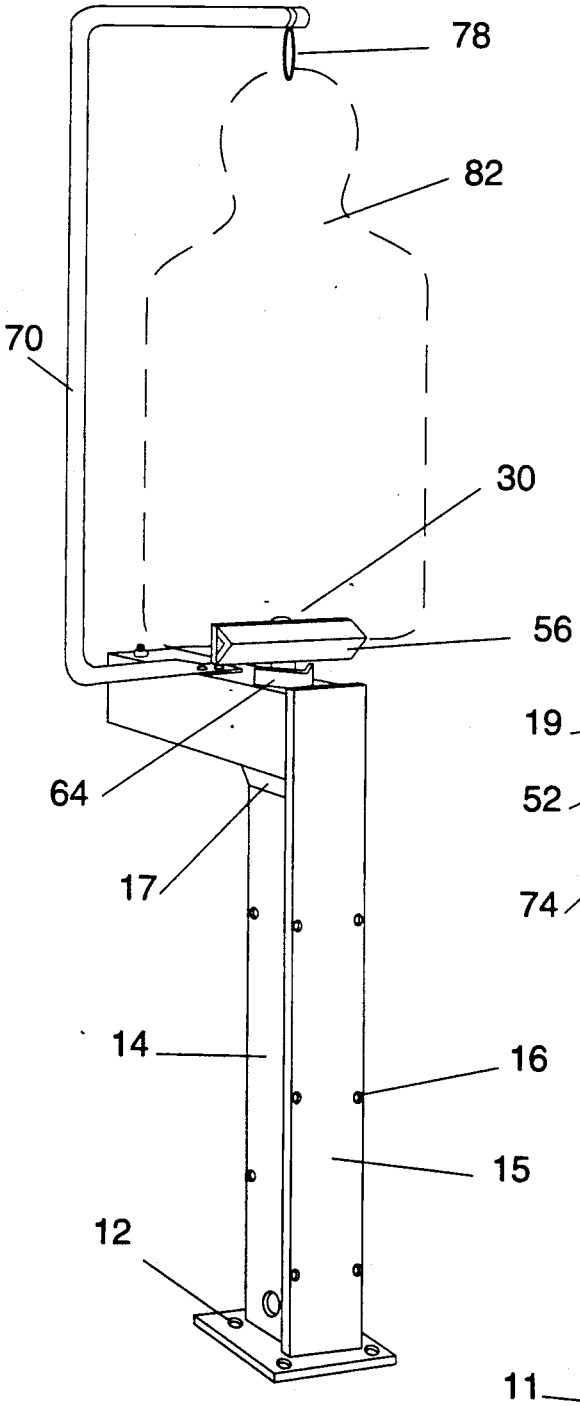
FIG. 1 shows a front angle of an embodiment of the target support structure and system in accordance with the present inventor.
Figure 2:
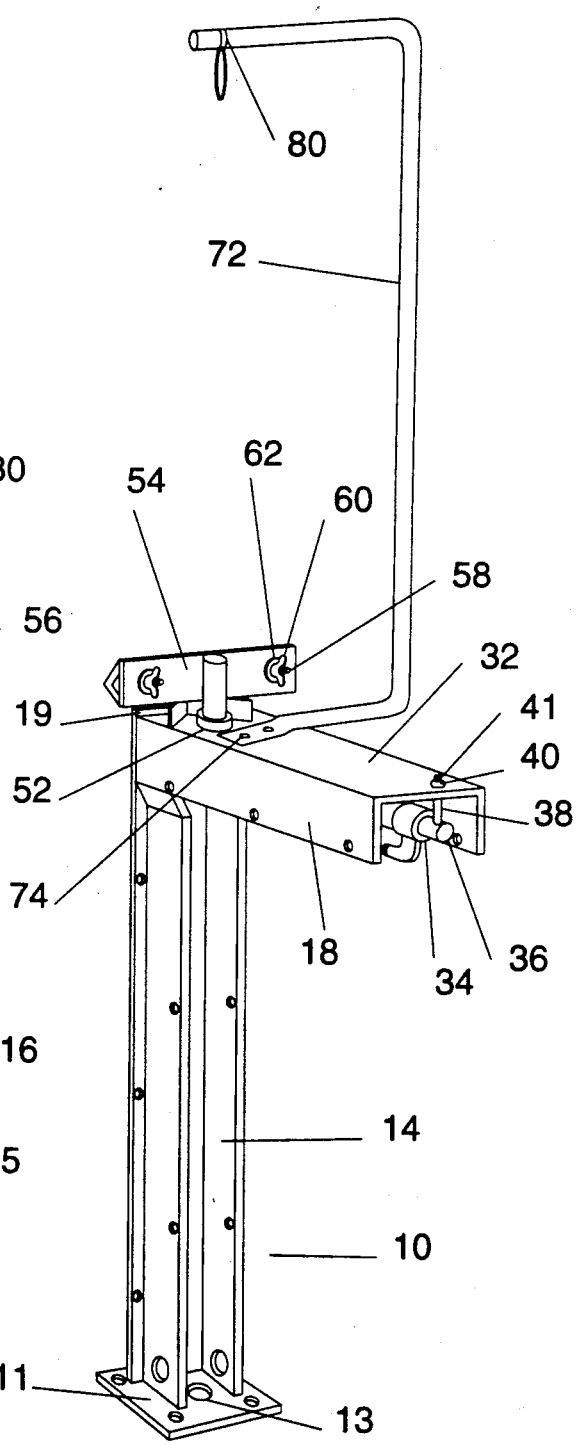
FIG. 2 shows a back angle of the embodiment of the target support structure and system in accordance with the present inventor.
Figure 3:
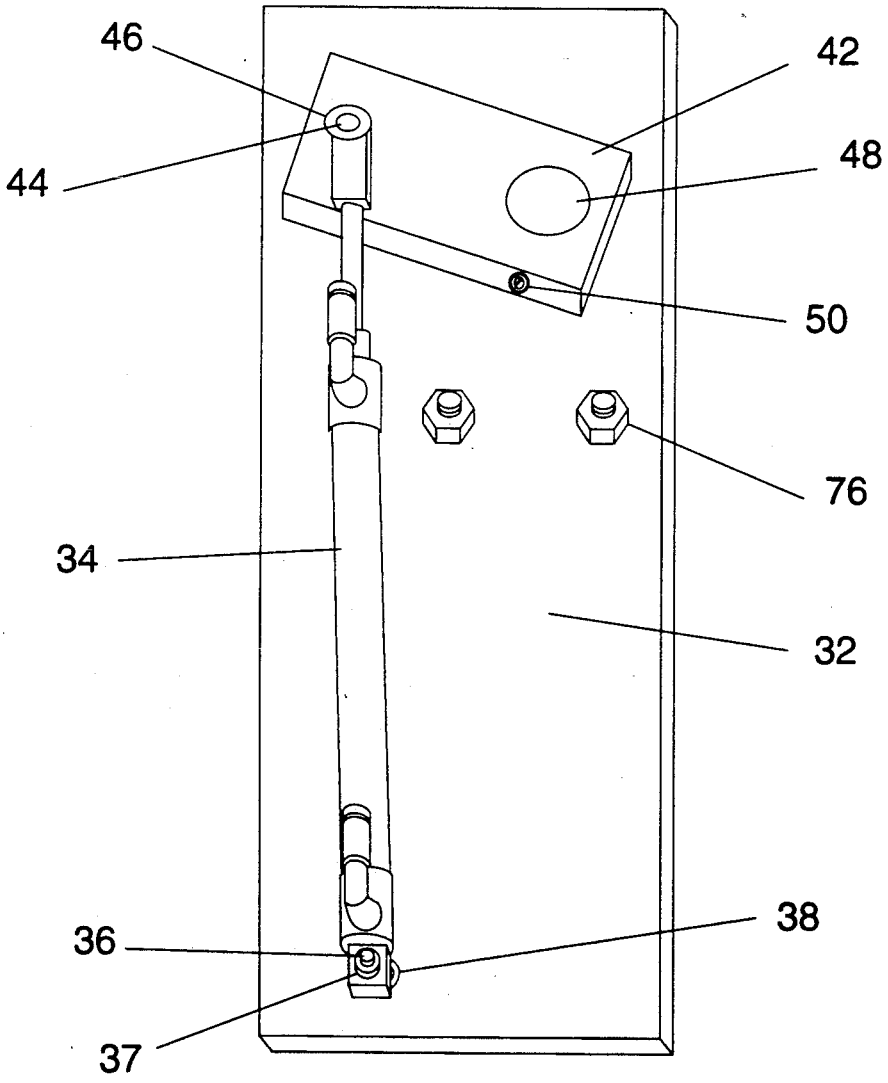
FIG. 3 shows the underside of the actuation unit which turns the clamp mechanism of the target support structure and system illustrated in FIGS. 1 and 2.

Referring to the accompanying drawings, there is illustrated a preferred embodiment of the target support system and structure system according to the present invention. The system, as shown in FIGS. 1, 2, and 3, includes a base(10), an activation unit(30), and a target frame support(70).

The base(10) is preferably comprised of ¼ inch galvanized steel. The mounting plate(11) has holes(12) near its edges for mounting the base(10) to a flat concrete pad or similar secure structure. The mounting plate(11) also has one or more conduit access holes(13), which are also shown in the upright side supports(14). These supports(14), the mounting plate(11), and the front plate(15), are all welded together.

The upright side supports(14) are recessed slightly from the edge of the front plate(15) to allow the facade mounting holes(16) to be easily accessed from the outside of the chamber formed from the side supports(14) and the front plate(15). This chamber can be enclosed by an optional back cover plate (not shown) to protect conduit which is run through the base(10) to power the activation unit(30). The front plate extends slightly above the top of the horizontal side plates(18) and the horizontal top plate(32) to form the return splatter stop(19).

At the top of each upright side support is a small angled steel plate(17) which is also connected to the horizontal side plate(18). These pieces are all welded to each other and to the front base plate(15). The two horizontal side plates(18) need to be slightly further apart than the distance between the upright side supports(14) to allow for the operation of the activation unit(30) as illustrated in this embodiment. However, another embodiment of this present invention could provide for the horizontal side plates(18) to be the same distance apart as the upright side supports(14) which would extend to and weld directly to the horizontal side plates(18) eliminating the need for the small angled steel plates(17). This modified embodiment, however, would require the front plate(15) to be wider in order to provide for the access to the facade mounting holes(16) as previously referenced. Having a wider front plate(15) would provide greater exposure to ammunition fire and damage and, therefore, the preferred embodiment has been designed as illustrated.

Another modification to the preferred embodiment could employ an angle shield (a v-shaped piece of metal) bolted to or used in place of the front plate(15) in such a manner as to deflect bullets which strike the base.

The activation unit(30) consists of the horizontal top plate(32) and everything mounted thereto, with the exception of the target support frame(70). Most of the parts comprising the activation unit(30) are made from machined steel. The activator piston(34) (which in the embodiment illustrated, is a commercially available reversible pneumatic piston) is mounted to the horizontal top plate(32) at one end by means of a nut and bolt assembly which consists basically of a bolt(37) and nut(41) that attach through a hole(36) in the activation piston(34), through a spacer(38), and through a hole(40) in the horizontal top plate(32). The other end of the activator piston(34) connects to the lever arm(42) by means of a lever pin(44) and lever clip(46). The lever arm(42) has a hole in it through which the main pivot(48) is attached and secured by a retaining pin(50). The main pivot(48) is spaced above and below the horizontal top plate by oil impregnated bronze bushings(52). Welded to the top of the main pivot(48) is the clamp rear(54) which attaches to the clamp front(56) by means of bolts(58) which are welded inside the clamp front(56) and protrude through holes in the rear clamp(54) and are secured by finger nuts(60) which tighten against washers(62). The clamp front is advantageously v-shaped to provide bullet deflection protection. The spatter shield(64) is welded to the horizontal top plate(32) in front of the main pivot.

The target frame support(70) basically consists of the frame bar(72) and the suspension band(78). The frame bar(72), which is preferably shaped steel rod, connects to the horizontal top plate(32) by bolts(74) which pass through the horizontal top plate(32) and are secured by nuts(76). The suspension band(78) in this embodiment is made of rubber and is simply tied through a hole in the top of any flat target(82) and looped over the end of the frame bar(72) into a groove(80). The suspension band(78) is a simple way of securing the top of any of a number of commercially available targets which could be used with this present invention. The target illustrated (82) is only a sample shape. A number of variations of the suspension band(78) which allow the free turning movement of a target could also be embodied including, but not limited to, straps made of other materials, strings, cords, or a simple mechanical pivot.

The operation of the preferred embodiment of this present invention is basically as follows: The base is mounted to a solid surface and the front plate(15) has a piece of two by six board or some similar facade attached. A target(80) is secured at its bottom between the clamp front(56) and the clamp rear(54). The top of the target is connected to the suspension band(78). Power is directed to the activation unit(30) by means of air hoses (not shown) which enter through the conduit holes(13), run through the base(10) and connect to the activator piston(34). (The means for controlling the flow of air power to the preferred embodiment is available through other external devices which are not a part of this present invention.)

The air flow is initially directed to retract the activator piston(34) which pulls the lever arm(42) and turns the main pivot(48) and the clamps(54 and 56) so the target is perpendicular to the frame bar(72). In this position, those facing the system will only see the edge of the target. Air flow can then be directed to extend the activator piston(34), exposing the face of the target to those facing the system. The target can be turned back and forth in this manner in a variety of patterns through the external control device(s) employed.

The preferred embodiment provides a number of protections from bullets shot at the target. The facade attached to the front plate(15) (generally a two by six board) helps prevent bullet splatter and damage to the embodiment. The facade can advantageously be easily and economically replaced as needed. The v-shaped clamp front(56), the rounded frame bar, and the splatter shield(64) also help deflect bullets to minimize damage. The return splatter stop(19) helps prevent bullets which strike the activation unit(30) from being deflected back towards a firearms operator. The frame bar is also designed (by size and shape) to adequately support the suspension band while providing minimal exposure to bullet damage.

It is understood that the present invention is not limited to the preferred embodiment presented or the variations thereof described but is susceptible to a number of modifications as are apparent to one skilled in the art. I do not, therefore, wish to limit the present invention to the details shown and described herein, but intend to cover all modifications which are obvious to one skilled in the art.

The embodiments of the invention in which an exclusive property or privilege is claimed are defined as follows:

1. An improved turning target system comprising:
(a) a stand readily mounted to a flat solid surface;
(b) a stationary horizontal top plate mounted on top of said stand;
(c) a clamp mechanism mounted to said horizontal top plate, said clamp mechanism comprising a clamp for firmly clamping the bottom edge of any one of a variety of flat targets in an upright vertical position, and a mechanism means for rotating said clamp and said target about a vertical axis relative to said stationary horizontal top plate;
(d) a stationary bar frame mounted to said horizontal top plate, said stationary bar frame having a top portion extending upwardly above said target;
(e) a flexible connection means having one end attached to said top portion of said stationary bar frame, and the other end attached to the upper portion of said target for stabilizing said target;
(f) said mechanism means for rotating said clamp and said target referenced in (c) comprises pneumatics or any adaptable power source;
(g) a design which allows interface with either an electric or a pneumatic control device for the power source referenced in (f) above;
(h) an armor design which protects the actuating system referenced in (f) above; and
(i) a design for protecting the system's support structure and minimizing bullet splatter, which design allows the mounting of a two by six board or similiar facade to the front face of the system's base.

2. A system according to claim 1 wherein the target movement is actuatable through pneumatics or any adaptable power source and is compatible for interface with either an electric or a pneumatic control device.

3. A system according to claim 1 wherein the actuating system and its support structure are designed to minimize bullet damage and splatter by both the application of advantageous shape to exposed component areas (i.e., the v-shape clamp front, the rounded bar frame, the splatter shield and the return splatter stop) and by the use of a mounting design for the front face of the system's base which allows for the attachment of a two by six board or similar facade which can "absorb" bullets and be replaced as needed.

* * * * *